US005728498A

United States Patent [19]

Yanus et al.

[11] Patent Number: 5,728,498

[45] Date of Patent: Mar. 17, 1998

[54] ELECTROPHOTOGRAPHIC IMAGING MEMBER HAVING AN IMPROVED CHARGE TRANSPORT LAYER

[75] Inventors: John F. Yanus, Webster; William W. Limburg, Penfield; Dale S. Renfer, Webster; Richard L. Schank, Pittsford; Merlin E. Scharfe, Penfield; Damodar M. Pai, Fairport; Paul J. DeFeo, Sodus Point, all of N.Y.

[73] Assignee: Xerox Corporation, Stamford, Conn.

[21] Appl. No.: 722,352

[22] Filed: Sep. 27, 1996

[51] Int. Cl.[6] ..... G03G 5/04

[52] U.S. Cl. ..... 430/59; 430/67

[58] Field of Search ..... 430/58, 59, 66, 430/67

[56] References Cited

U.S. PATENT DOCUMENTS

| | | | |
|---|---|---|---|
| 4,621,009 | 11/1986 | Lad | 428/216 |
| 4,871,634 | 10/1989 | Limburg et al. | 430/54 |
| 4,983,481 | 1/1991 | Yu | 430/59 |
| 5,167,987 | 12/1992 | Yu | 430/59 |
| 5,283,143 | 2/1994 | Yanus et al. | 430/59 |

*Primary Examiner*—John Goodrow

[57] ABSTRACT

A flexible electrophotographic imaging member including a supporting substrate coated with at least one imaging layer comprising hole transporting material containing at least two long chain alkyl carboxylate groups dissolved or molecularly dispersed in a film forming binder.

11 Claims, No Drawings

ELECTROPHOTOGRAPHIC IMAGING MEMBER HAVING AN IMPROVED CHARGE TRANSPORT LAYER

BACKGROUND OF THE INVENTION

This invention relates in general to electrostatography and, more specifically, to an electrostatographic imaging member having a charge transport layer containing a hole transporting material containing at least two long chain alkyl carboxylate groups.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive materials exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed is a binder. Other examples of homogeneous dispersions of conductive material in binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

If a thin, flat biaxially oriented polyethylene terephthalate (e.g. 3 mil thick PET) web is coated with thick imaging layer such as a solution of 50 percent by weight polycarbonate (e.g. Makrolon) and 50 percent by weight aromatic diamine dissolved in a solvent to form a charge transport layer (CTL), the web tends to curl when the coating solvent evaporates due to the dimensional contraction of the applied coating from the point in time when the applied CTL coating solidifies and adheres to the underlying surface. Once this solidification and adhesion point is reached, further evaporation of coating solvent causes continued shrinking of the applied coating layer due to volume contraction resulting from removal of additional solvent will cause the coated web to curl toward the applied layer because the PET substrate does not undergo any dimensional changes. This shrinking occurs isotropically, i.e., three-dimensionally. In other words, from the point in time when the applied coating has reached a solid state and is anchored at the interface with the underlying support layer, continued shrinking of the applied coating causes dimensional decreases in the applied coating which in turn builds up internal tension stress and, therefore, forces the entire coated structure to curl toward the dry CTL applied coating. If the coated article has a circular shape, the curled structure will resemble that of a bowl. Curling is undesirable because different segments of the imaging surface of the photoconductive member are located at different distances from charging devices, developer applicators, toner image receiving members and the like during the electrophotographic imaging process thereby adversely affecting the quality of the ultimate developed images. For example, non-uniform charging distances can be manifested as variations in high background deposits during development of electrostatic latent images. An imaging member having a tendency to curl can spontaneously form a roll as small as 3.8 cm in diameter and, requires considerable tension to flatten the imaging member against the surface of a separate supporting device. Where the supporting device comprises a large flat area for full frame flash exposure, the imaging member may tear before sufficient flatness can be achieved. Moreover, constant flexing of multilayered photoreceptor belts during cycling can cause stress cracks to form due to fatigue. These cracks print out on the final electrophotographic copy. Premature failure due to fatigue prohibits use of these belts in designs utilizing small roller sizes (e.g. 19 mm or smaller) for effective auto paper stripping. Coatings may be applied to the side of the supporting substrate opposite the electrically active layer or layers to counteract the tendency to curl. However, such coating requires an additional coating step on a side of the substrate opposite from the side where all the other coatings are applied. This additional coating operation normally requires that a substrate web be unrolled an additional time merely to apply the anticurl layer. Also, many of the solvents utilized to apply the anti-curl layer require additional steps and solvent recovery equipment to minimize solvent pollution of the atmosphere. Further, equipment required to apply the anti-curl coating must be cleaned with solvent and refurbished from time to time. The additional coating operations raise the cost of the photoreceptor, increase manufacturing time, decrease production throughput, and increases the likelihood that the photoreceptor will be damaged by the additional handling. In addition, the anti-curl backing layer can form bubbles during application which requires scrapping of that portion of the photoreceptor containing the bubbles. This in turn reduces total manufacturing yield. Also, difficulties have been encountered with these anti-curl coatings. For example, photoreceptor curl can sometimes still be encountered due to a decrease in anticurl layer thickness resulting from wear in as few as 1,500 imaging cycles when the photoreceptor belt is exposed to stressful operating conditions of high temperature and high humidity. The curling of the photoreceptor is inherently caused by internal stress build-up in the electrically active layer or layers of the photoreceptor which promotes dynamic fatigue cracking, thereby shortening the mechanical life of the photoreceptor. Further, the anticurl coatings occasionally separate from the substrate during extended machine cycling and render the photoconductive imaging member unacceptable for forming quality images. Anticurl layers will also occasionally delaminate due to poor adhesion to the supporting substrate. Moreover, in electrostatographic imaging systems where transparency of the substrate and anticurl layer are necessary for rear exposure erase to activating electromagnetic radiation, any reduction of transparency due to the presence of an anticurl layer will cause a reduction in performance of the photoconductive imaging member. Although the reduction in transparency may in some cases be compensated by increasing the intensity of the electromagnetic radiation, such increase is generally undesirable due to the amount of heat generated as well as the greater costs necessary to achieve higher intensity.

Further, the anticurl coating introduces mechanical stresses which, when perturbed by wear, results in distortions which resemble ripples. These ripples are the most serious photoreceptor related problem in advanced precision imaging machines that demand precise tolerances. When ripples are present, different segments of the imaging surface of the photoconductive member are located at different distances from charging devices, developer applicators, toner image receiving members and the like during the electrophotographic imaging process thereby adversely affecting the quality of the ultimate developed images. For example, non-uniform charging distances can be manifested as variations in high background deposits during development of electrostatic latent images. It is theorized that since the anticurl backing layer is usually composed of material that is less wear resistant than the adjacent substrate layer, it wears rapidly during extended image cycling, particularly when supported by stationary skid plates. This wear is nonuniform and leads to the distortions which resemble ripples and also produces debris which can form undesirable deposits on sensitive optics, corotron wires and the like.

INFORMATION DISCLOSURE STATEMENT

U.S. Pat. No. 5,167,987 to Yu, issued—A process for fabricating an electrostatographic imaging member is disclosed comprising providing a flexible substrate comprising a solid thermoplastic polymer, forming an imaging layer coating comprising a film forming polymer on the substrate, heating the coating, cooling the coating, and applying sufficient predetermined biaxial tensions to the substrate while the imaging layer coating is at a temperature greater than the glass transition temperature of the imaging layer coating to substantially compensate for all dimensional thermal contraction mismatches between the substrate and the imaging layer coating during cooling of the imaging layer coating and the substrate, removing application of the biaxial tension to the substrate, and cooling the substrate whereby the final hardened and cooled imaging layer coating and substrate are substantially free of stress and strain.

U.S. Pat. No. 4,983,481 to Yu, issued Jan. 8, 1991—An imaging member without an anti-curl layer is disclosed having improved resistance to curling. The imaging member comprises a flexible supporting substrate layer, an electrically conductive layer, an optional adhesive layer, a charge generator layer and a charge transport layer, the supporting layer having a thermal contraction coefficient substantially identical to the thermal contraction coefficient of the charge transport layer.

U.S. Pat. No. 4,621,009 to Lad, issued Nov. 4, 1986—A coating composition is disclosed for application onto a plastic film to form a coating capable of bonding with xerographic toner. The coating composition consists of a resin binder, preferably a polyester resin, a solvent for the resin binder, filler particles, and at least one crosslinking and antistatic agent. The coating composition is applied to a polyester film, preferably a film of polyethylene terephthalate, under conditions sufficient to fix toner onto the coating without wrinkling.

U.S. Pat. No. 4,871,634 to W. Limburg et al., issued Oct. 3, 1989—A hydroxy arylamine compound, represented by a specific formula, is disclosed as employable in photoreceptors.

Thus, the characteristics of many electrostatographic imaging members comprising a supporting substrate coated on one side with at least one photoconductive layer and coated or uncoated on the other side with an anticurl layer exhibit deficiencies which are undesirable in automatic, cyclic electrostatographic copiers, duplicators, and printers.

SUMMARY OF THE INVENTION

It is an object of the invention to provide an electrostatographic imaging member which overcomes the above-noted disadvantages. =p It is another object of this invention to provide an electrostatographic imaging member process with improved resistance to curling.

It is another object of this invention to provide an electrostatographic imaging member which is less complex.

It is another object of this invention to provide an electrostatographic imaging member capable of being fabricated with a simpler coating process.

It is another object of this invention to provide an electrostatographic imaging member free of an anticurl backing layer.

It is still another object of this invention to provide an electrostatographic imaging member having improved resistance to the formation of ripples in the form of crossweb sinusoidal deformations when subjected to extended image cycling.

It is another object of this invention to provide an electrostatographic imaging member exhibiting an increased cycling life.

The foregoing objects and others are accomplished in accordance with this invention by providing a flexible electrophotographic imaging member including a supporting substrate coated with at least one imaging layer comprising hole transporting material containing at least two long chain alkyl carboxylate groups dissolved or molecularly dispersed in a film forming binder. Preferably, the flexible electrophotographic imaging member is free of an anticurl backing layer, the imaging member comprising a supporting substrate uncoated on one side and coated on the opposite side with at least a charge generating layer and a charge transport layer, the transport layer comprising hole transporting material containing at least two long chain alkyl carboxylate groups dissolved or molecularly dispersed in a film forming binder.

The term "substrate" is defined herein as a flexible member comprising a solid thermoplastic polymer that is uncoated or coated on the side to which a charge generating layer and a charge transport layer are to be applied and free of any anticurl backing layer on the opposite side.

Generally, the imaging member comprises a flexible supporting substrate having an electrically conductive surface and at least one imaging layer. The imaging generating e a single layer combining the charge generating and charge transporting functions or these functions may be separated, each in its own optimized layer. The flexible supporting substrate layer having an electrically conductive surface may comprise any suitable flexible web or sheet comprising a solid thermoplastic polymer. The flexible supporting substrate layer having an electrically conductive surface may be opaque or substantially transparent and may comprise numerous suitable materials having the required mechanical properties. For example, it may comprise an underlying flexible insulating support layer coated with a flexible electrically conductive layer, or merely a flexible conductive layer having sufficient mechanical strength to support the electrophotoconductive layer or layers. The flexible electrically conductive layer, which may comprise the entire supporting substrate or merely be present as a coating on an underlying flexible web member, may comprise any suitable electrically conductive material including, for example, aluminum, titanium, nickel, chromium, brass, gold, stainless steel, copper iodide, carbon black, graphite and the like dispersed in the solid thermoplastic polymer. The flexible conductive layer may vary in thickness over substantially wide ranges depending on the desired use of the electrophotoconductive member. Accordingly, the conductive layer can generally range in thicknesses of from about 50 Angstrom units to about 150 micrometers. When a highly flexible photoresponsive imaging device is desired, the thickness of the conductive layer may be between about 100 Angstrom units to about 750 Angstrom units. Any suitable underlying flexible support layer of any suitable material containing a thermoplastic film forming polymer alone or a thermoplastic film forming polymer in combination with other materials may be used. Typical underlying flexible support layers comprise film forming polymers include, for example, polyethylene terepthalate, polyimide, polysulfone, polyethylene naphthalate, polypropylene, nylon, polyester, polycarbonate, polyvinyl fluoride, polystyrene and the like. Specific examples of supporting substrates include polyethersulfone (Stabar S-100, available from from ICI), polyvinyl fluoride (Tedlar, available from E. I. DuPont de Nemours & Company), polybisphenol-A polycarbonate (Makrofol, available from Mobay Chemical Company) and amorphous polyethylene terephthalate (Melinar, available from ICI Americas, Inc.).

The coated or uncoated flexible supporting substrate layer is highly flexible and may have any number of different configurations such as, for example, a sheet, a scroll, an endless flexible belt, and the like. Preferably, the insulating web is in the form of an endless flexible belt and comprises a commercially available biaxially oriented polyethylene terephthalate substrate known as Melinex 442, available from ICI.

If desired, any suitable charge blocking layer may be interposed between the conductive layer and the photogenerating layer. Some materials can form a layer which functions as both an adhesive layer and charge blocking layer. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because its cyclic stability is extended. The entire disclosure of U.S. Pat. No. 4,464,450 is incorporated herein by reference. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof.

Generally, satisfactory results may be achieved when the reaction product of a hydrolyzed silane and metal oxide layer forms a blocking layer having a thickness between about 20 Angstroms and about 2,000 Angstroms.

In some cases, intermediate layers between the blocking layer and the adjacent charge generating or photogenerating layer may be desired to improve adhesion or to act as an electrical barrier layer. If such layers are utilized, they preferably have a dry thickness between abut 0.01 micrometer to about 5 micrometers. Typical adhesive layers include film forming polymers such as polyester, polyvinylbutyral, polyvinylpyrolidone, polyurethane, polymethyl methacrylate and the like.

Generally, the electrophotoconductive imaging member of this invention comprises a supporting substrate layer, a metallic conductive layer, a charge blocking layer, an optional adhesive layer, a charge generator layer, a charge transport layer. The electrophotoconductive imaging member of this invention is free of any anti-curl layer on the side of the substrate layer opposite the electrically active charge generator and charge transport layers, although a back coating may be optionally present to provide some other benefit such as increased traction and the like. Any suitable charge generating or photogenerating material may be employed as one of the two electrically operative layers in the multilayer photoconductor of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,265,990, U.S. Pat. No. 4,233,384, U.S. Pat. No. 4,471,041, U.S. Pat. Nos. 4,489,143, 4,507,480, U.S. Pat. Nos. 4,306,008, 4,299,897, U.S. Pat. No. 4,232,102, U.S. Pat. No. 4,233,383, U.S. Pat. No. 4,415,639 and U.S. Pat. No. 4,439,507. The disclosure of these patent are incorporated herein by reference in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymer: The photogenerating composition or pigment is present in the resinous binder composition in various amounts. When using an electrically inactive or insulating resin, it is important that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly(N-vinyl carbazole), a photoconductive material need only to comprise about 1 percent or less by volume of the binder layer with no limitation on the maximum amount of photoconductor in the binder layer. Generally for generator layers containing an electrically active matrix or binder such as poly(N-vinyl carbazole) or poly(hydroxyether), from about 5 percent by volume to about 60 percent by volume of the photogenerating pigment is dispersed in about 95 percent by volume to about 40 percent by volume of binder, and preferably from about 7 percent to about 30 percent by volume of the photogenerating pigment is dispersed in from about 93 percent by volume to about 70 percent by volume of the binder. The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The relatively thick active charge transport layer, in general, comprises a hole transporting molecule containing at least two long chain alkyl carboxylate groups dissolved or molecularly dispersed in a film forming binder. The charge transport layer should also be capable of supporting the injection of photo-generated holes and electrons from the charge transport layer and allowing the transport of these holes or electrons through the charge transport layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 40,00 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the charge generation layer in the instant invention is a material which is an insulator to the extent that an electrostatic charge placed on the transport layer is not conductive in the absence of illumination, i.e. a rate sufficient to prevent the formation and retention of an electrostatic latent image thereon.

Polymers having the capability of transporting holes contain repeating units of a polynuclear aromatic hydrocarbon which may also contain heteroatoms such as, for example, nitrogen, oxygen or sulfur. Typical polymers include poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; the polymeric reaction product of N,N'-diphenyl N,N'-bis (3-hydroxy phenyl)-[1,1'biphenyl]-4,4'diamine and diethylene glycol bischloroformate, and the like.

The active charge transport layer must comprise a hole transporting material containing at least two long chain alkyl carboxylate groups dissolved or molecularly dispersed in a film forming binder. This hole transporting material is an activating compound useful as an additive dispersed in electrically inactive polymeric materials making these materials electrically active and this mixture may optionally contain a conventional hole transporting molecule. These hole transporting materials containing at least two long chain alkyl carboxylate groups are added to charge transporting polymeric materials or to polymeric materials which are incapable of supporting the injection of photogenerated holes from the generation material and incapable of allowing the transport of these holes therethrough. Addition of these hole transporting materials containing at least two long chain alkyl carboxylate groups will convert the electrically inactive polymeric material to a material capable of supporting the injection of photogenerated holes from the generation material and capable of allowing the transport of these holes through the active layer in order to discharge the surface charge on the active layer.

The hole transporting materials containing at least two long chain alkyl carboxylate groups is derived from a charge transporting reactant selected from the group consisting of tertiary amine containing molecules and the like and mixtures thereof. Preferred charge transporting materials of this invention can be represented by the following formula:

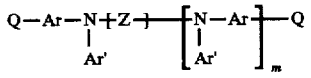

wherein:

m is 0 or 1,

Z is selected from the group consisting of:

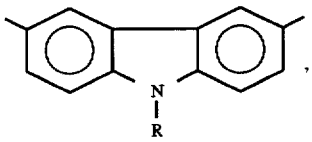

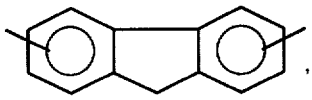

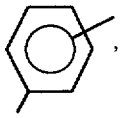

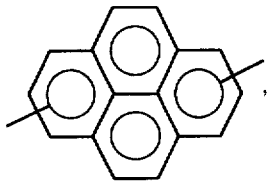

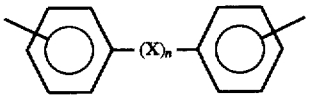

n is 0 or 1,

Ar is selected from the group consisting of:

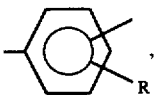

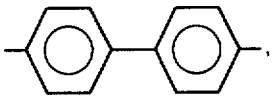

and

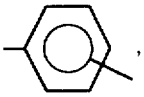

R is selected from the group consisting of $—CH_3$, $—C_2H_5$, $—C_3H_7$, and $—C_4H_9$, Ar' is selected from the group consisting of:

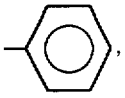

-continued

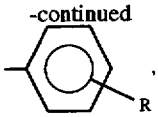

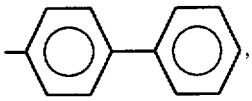

and

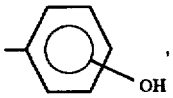

X is selected from the group consisting of:

$-CH_2-$, $-C(CH_3)_2-$, $-O-$, $-S-$,

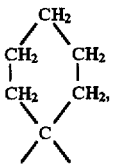

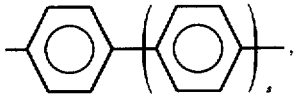

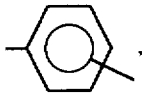

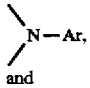

and

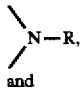

and s is 0, 1 or 2, and

Q is represented by the formula:

$$\leftarrow O)_p \leftarrow CR_1R_2)_s - \overset{O}{\overset{\|}{C}} - O \leftarrow CR_3R_4)_n - CH_3$$

wherein:

p is 1 or 0

$R_1$, $R_2$, $R_3$, $R_4$ are independently selected from —H, $—CH_3$, $—(CH_2—)_vCH_3$, $—CH(CH_3)_2$, $—C(CH_3)_3$ wherein v is 1 to 10, and s and n are independently selected from 0 to 10.

A preferred charge transporting unit that ultimately attaches to long chain alkyl carboxylate groups is an arylamine. Preferably, the arylamine is represented by the following formula:

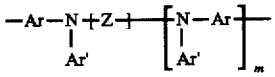

wherein AR, Ar', Z and m are as defined above with reference to the formula representing the preferred hole transporting materials containing at least two long chain alkyl carboxylate groups.

The hole transporting material containing at least two long chain alkyl carboxylate groups may be employed as the only charge transporting material in the charge transport layer of the photoreceptor of this invention or admixed with other charge transporting materials. Any other suitable charge transporting material may be utilized for this admixture. Typical other charge transporting materials include, for example, aromatic amine compounds, the polymeric reaction product of N,N'-diphenyl N,N' bis (3-hydroxy phenyl)

-[1,1'biphenyl]-4,4'diamine and diethylene glycol bischloroformate, N,N'-diphenyl N,N' bis (3-methoxy phenyl)-[1,1' biphenyl]-4,4'diamine, N,N'-diphenyl N,N' bis (3-methyl phenyl)-[1,1' biphenyl]-4,4'diamine, and the like and mixtures thereof. The weight of the hole transporting material containing at least two long chain alkyl carboxylate groups should be between about 15 and about 75 per cent by weight of the dried transport layer to form a transport layer that is substantially free of internal stress. The expression "substantially free of internal stress" as employed herein is defined as lacking in unbalanced internal forces in the bulk which can lead to physical distortion of materials. When less that about 15 percent is employed, the flexible photoreceptor tends to curl when unrestrained. If the amount of transporting material containing at least two, long chain alkyl carboxylate groups exceeds about 75 percent by weight, crystallization may set in resulting in the degradation of image quality. Preferably, the charge transport layer of the photoreceptor of this invention contains between about 20 percent and about 50 percent by weight of the hole transporting material containing at least two long chain alkyl carboxylate groups.

A preferred charge transporting material for admixing with the hole transporting material containing at least two long chain alkyl carboxylate groups is an aromatic amine compound having the general formula:

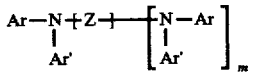

wherein:

m is 0or 1,

Z is selected from the group consisting of:

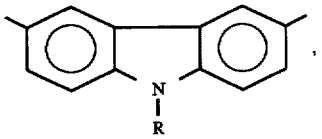

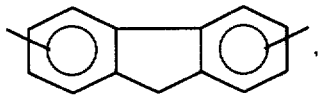

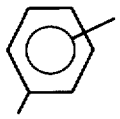

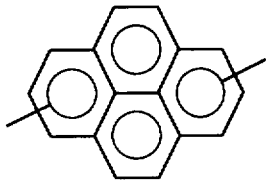

and

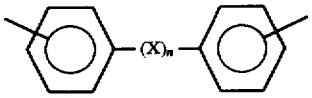

n is 0 or 1,

Ar is selected from the group consisting of:

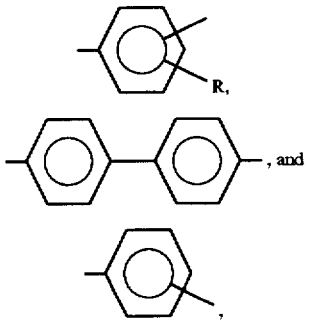

R is selected from the group consisting of —$CH_3$, —$C_2H_5$, —$C_3H_7$, and —$C_4H_9$, Ar' is selected from the group consisting of:

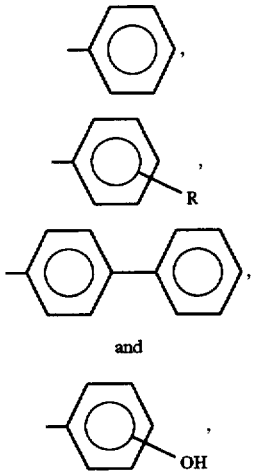

and

X is selected from the group consisting of:

$-CH_2-$, $-C(CH_3)_2-$, $-O-$, $-S-$,

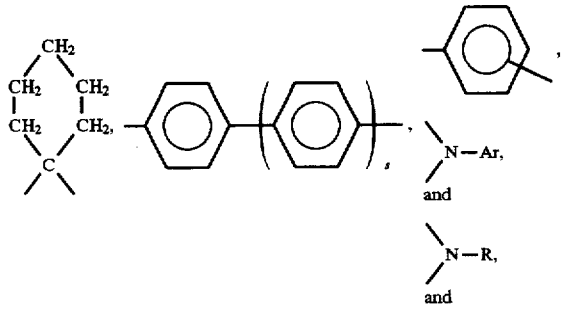

s is0, 1 or 2.

Examples of charge transporting aromatic amines for admixing with transporting material containing at least two long chain alkyl carboxylate groups include triphenylmethane, bis(4-diethylamine-2-methylphenyl) phenylmethane; 4'-4"-bis(diethylamino)-2', 2"-dimethyltriphenyl-methane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis (chlorophenyl)-[1,1'-biphenyl]-4,4'-diamine, N,N'-diphenyl-N,N'-bis(3"-methylphenyl)-(1,1'-biphenyl)-4,4'-diamine, and the like. The charge transport layer of the photoreceptor of this invention may contain between 0 and about 60 percent by weight of the additional hole transporting material, based on the total weight of the dried transport layer. In all of the above charge transport layers, the total activating compounds which renders electrically inactive polymeric material electrically active is preferably present in amounts of from about 15 to about 75 percent by weight.

Any suitable inactive resin binder soluble in a suitable solvent may be employed in the process of this invention. Typical inactive resin binders soluble in solvents include, for example, polycarbonate resin, polystyrene resins, polyether carbonate resins, polyester resins, copolyester resins, terpolyester resins, polystyrene resins, polyarylate resins and the like and mixtures thereof. Polycarbonate resins include, for example, poly(4,4'-isopropylidenediphenyl carbonate) [polycabonate A]; polyether carbonate resins; 4,4'-cyclohexylidene diphenyl polycarbonate [polycarbonate Z]; poly(4,4'-isopropylidene-3,3'-dimethyl-diphenyl-carbonate) [polycarbonate C]; poly(4,4'-diphenyl-methyl phenyl-carbonate) [polycarbonate P]; and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-isopropylidene-diphenylene carbonate) with a molecular weight of from about 35,000 to about 40,000 (available as Lexan 145 from General Electric Company); poly(4,4'-isopropylidene-diphenylene carbonate) with a molecular weight of from about 40,000 to about 45,000 (available as Lexan 141 from the General Electric Company); a polycarbonate resin having a molecular weight of from about 50,000 to about 100,000, (available as Makrolon from Farbenfabricken Bayer A.G.) and a polycarbonate resin having a molecular weight of from about 20,000 to about 50,000 (available as Merlon from Mobay Chemical Company). The most preferred polycarbonates resins are polycarbonate A, polycarbonate C and polycarbonate Z. Methylene chloride solvent is a desirable component of the charge transport layer coating mixture for adequate dissolving of all the components and for its low boiling point.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400: 1.

Optionally, a thin overcoat layer may also be utilized to improve resistance to abrasion. These overcoating layers may comprise organic polymers or inorganic polymers that are electrically insulating or slightly semi-conductive.

EXAMPLE I

Six flexible photoreceptor sheets were prepared by forming coatings using conventional techniques on a substrate comprising a vacuum deposited titanium layer on a flexible polyethylene terephthalate film having a thickness of 3 mil (76.2 micrometers). The first coating was a siloxane barrier layer formed from hydrolyzed gamma aminopropyltriethoxysilane having a thickness of 0.005 micrometer (50 Angstroms). This layer was coated from a mixture of 3-aminopropyltriethoxysilane (available from PCR Research Chemicals of Florida) in ethanol in a 1:50 volume ratio. The coating was applied to a wet thickness of 0.5 mil by a multiple clearance film applicator. The coating was then allowed to dry for 5 minutes at room temperature, followed by curing for 10 minutes at 110 degree centigrade in a forced air oven. The next applied coating was an adhesive layer of polyester resin (49,000, available from E. I. duPont de Nemours & Co.) having a thickness of 0.005 micron (50 Angstroms) and was coated from a mixture of 0.5 gram of 49,000 polyester resin dissolved in 70 grams of tetrahydrofuran and 29.5 grams of cyclohexanone. The coating was applied by a 0.5 mil bar and cured in a forced air oven for 10 minutes. This adhesive interface layer was thereafter coated with a photogenerating layer (CGL) containing 40 volume hydroxygallium phthalocyanine and 60 percent by volume copolymer polystyrene (82 percent)/poly-4-vinyl pyridine (18 percent) with a Mw of 11,000. This photogenerating coating mixture was prepared by introducing 1.5 grams polystyrene/poly-4-vinyl pyridine and 42 ml of toluene into a 4 oz. amber bottle. To this solution was added 1.33 grams of hydroxygallium phthalocyanine and 300 grams of 1/8 inch diameter stainless steel shot. This mixture was then placed on a ball mill for 20 hours. The resulting slurry was thereafter applied to the adhesive interface with a Bird applicator to form a layer having a wet thickness of 0.25 mil. The layer was dried at 135° C. for 5 minutes in a forced air oven to form a dry thickness photogenerating layer having a thickness of 0.4 micrometer.

Six coated members prepared as described above were coated with charge transport layers containing N,N'-diphenyl-N,N'-bis(3-methyl-phenyl)-( 1,1' biphenyl)-4,4'-diamine (TBD) and N,N'-diphenyl-N,N'-bis {3-{oxypentyl ethylcarboxylate}phenyl}-4,4'-biphenyl-1,1' diamine (TBD-OPEC) molecularly dispersed in a polycarbonate resin [poly (4,4'-isopropylidene-diphenylene carbonate, available as Makrolon® from Farbenfabricken Bayer A. G.]. First 1.2 grams of polycarbonate polymer was dissolved in 13.2 grams of methylene chloride to form a polymer solution. X grams of TBD and Y grams of TBD-OPEC were dissolved in the polymer solution. The charge transport layer coatings were formed using a Bird coating applicator. The N,N'-diphenyl-N,N'-bis(3-methyl-phenyl)-(1,1' biphenyl)-4,4'-diamine (TBD) and N,N'-diphenyl-N,N'-bis {3-{oxypentyl ethylcarboxylate}phenyl}-4,4'-biphenyl-1,1' diamine (TBD-OPEC) are electrically active aromatic diamine charge transport small molecule whereas the polycarbonate resin is an electrically inactive film forming binder. Each of the coated devices were dried at 80° C. for half an hour in a forced air oven to form a 25 micrometer thick charge transport layer on the coated members. The compositions of six transport layers on the coated members are shown in the table below:

| Device # | Polycarbonate | TBD (X) | TBD-OPEC(Y) |
|---|---|---|---|
| 1 | 1.2 gram | 1.2 gram | |
| 2 | 1.2 gram | | 1.2 gram |
| 3 | 1.2 gram | 0.96 gram | 0.374 gram |
| 4 | 1.2 gram | 0.72 gram | 0.48 gram |
| 5 | 1.2 gram | 0.6 gram | 0.6 gram |
| 6 | 1.2 gram | 0.6 gram | 0.93 gram |

EXAMPLE II

The six flexible photoreceptor sheets prepared as described in Example I were tested for flatness by placing them in an unrestrained condition on a flat surface. Photoreceptor device No. 1 curled upwardly into a small diameter roll. Devices No. 2 through 6 laid flat. No curl was observed in these five flexible photoreceptor sheets.

EXAMPLE III

The flexible photoreceptor sheets prepared as described in Example I were tested for their xerographic sensitivity and cyclic stability. Each photoreceptor sheet to be evaluated was mounted on a cylindrical aluminum drum substrate which was rotated on a shaft. The device was charged by a corotron mounted along the periphery of the drum. The surface potential was measured as a function of time by capacitively coupled voltage probes placed at different locations around the shaft. The probes were calibrated by applying known potentials to the drum substrate. Each photoreceptor sheet on the drum was exposed by a light source located at a position near the drum downstream from the corotron. As the drum was rotated, the initial (pre exposure) charging potential was measured by voltage probe 1. Further rotation lead to the exposure station, where the photoreceptor device was exposed to monochromatic radiation of known intensity. The device was erased by a light source located at a position upstream of charging. The measurements made included charging of the photoconductor device in a constant current or voltage mode. The device was charged to a negative polarity corona. As the drum was rotated, the initial charging potential was measured by voltage probe 1. Further rotation lead to the exposure station, where the photoreceptor device was exposed to monochromatic radiation of known intensity. The surface potential after exposure was measured by voltage probes 2 and 3. The device was finally exposed to an erase lamp of appropriate intensity and any residual potential was measured by voltage probe 4. The process was repeated with the magnitude of the exposure automatically changed during the next cycle. The photodischarge characteristics was obtained by plotting the potentials at voltage probes 2 and 3 as a function of light exposure. The charge acceptance and dark decay were also measured in the scanner. The PhotoInduced Discharge characteristics (PIDC) and the cyclic stability of all the six devices were essentially equivalent.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A flexible electrophotographic imaging member comprising a supporting substrate coated with at least one imaging layer comprising hole transporting material containing long chain alkyl carboxylate groups dissolved or molecularly dispersed in a film forming binder, wherein said supporting substrate is uncoated on one side and coated on the opposite side with said least one imaging layer and wherein said hole transporting material is represented by the formula:

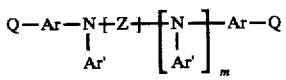

wherein:

m is 0 or 1,

Z is selected from the group consisting of:

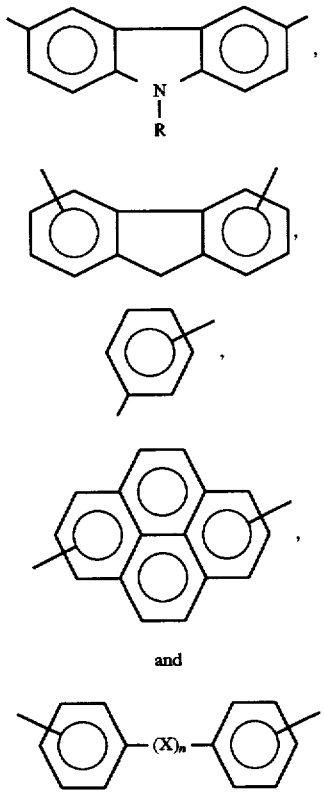

and n is 0 or 1,

Ar is selected from the group consisting of:

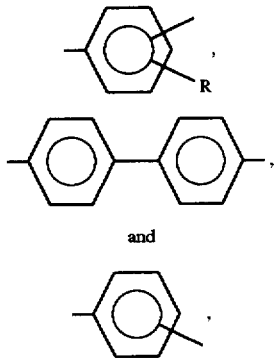

and

R is selected from the group consisting of —$CH_3$, —$C_2H_5$,—$C_3H_7$, and —$C_4H_9$, Ar' is selected from the group consisting of:

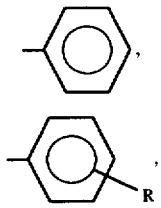

-continued

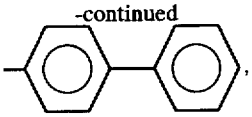

and

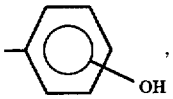

X is selected from the group consisting of:

$-CH_2-$, $-C(CH_3)_2-$, $-O-$, $-S-$,

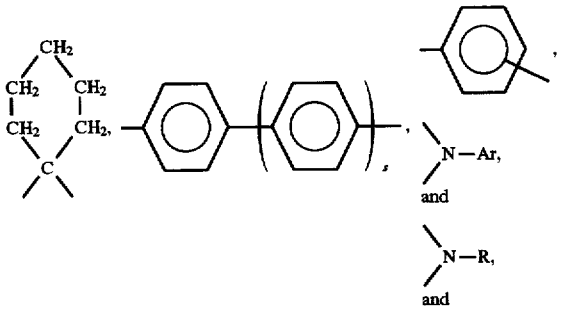

s is 0, 1 or 2, and

Q is represented by the formula:

$$\leftarrow O)_p\leftarrow CR_1R_2)_s-\overset{O}{\overset{\|}{C}}-O\leftarrow CR_3R_4)_n-CH_3$$

wherein:

p is 1 or 0, $R_1$, $R_2$, $R_3$, $R_4$ are independently selected from —H, $-CH_3$, $-(CH_2-)_vCH_3$, $-CH(CH_3)_2$, $-C(CH_3)_3$ wherein v is 1 to 10, and s and n are independently selected from 0 to 10.

2. An electrophotographic imaging member according to claim 1 wherein said hole transporting material containing at least two long chain alkyl carboxylate groups is an ethylcarboxylate diamine.

3. An electrophotographic imaging member according to claim 2 wherein said ethylcarboxylate diamine is N,N'-Diphenyl-N,N'-bis {3-{oxypentyl ethylcarboxylate}phenyl}-4,4"-biphenyl-1,1" diamine.

4.An electrophotographic imaging member according to claim 2 wherein said at least one imaging layer comprises a charge generating layer and a charge transport layer, said charge transport layer comprising said ethylcarboxylate diamine.

5. An electrophotographic imaging member according to claim 4 wherein said transport layer comprises a mixture of said hole transporting ethylcarboxylate diamine and a different hole transporting material dissolved or molecularly dispersed in said film forming binder.

6. An electrophotographic imaging member according to claim 1 wherein said supporting substrate comprises polyethylene terephthalate.

7. An electrophotographic imaging member according to claim 4 wherein said transport layer is substantially free of internal stress.

8. An electrophotographic imaging member according to claim 1 wherein said film forming binder comprises a polycarbonate.

9. An electrophotographic imaging member according to claim 8 wherein said polycarbonate film forming binder is selected from the group consisting of polycarbonate A, polycarbonate C and polycarbonate Z.

10. An electrophotographic imaging member according to claim 6 wherein said at least one imaging layer comprises a charge generating layer and a charge transport layer, said charge transport layer comprising between about 85 percent and about 25 percent by weight of said polycarbonate film forming binder and between about 15 percent and about 75 percent by weight of said ethylcarboxylate diamine, based on the total weight of said transport layer.

11. An electrophotographic imaging member according to claim 1 wherein said flexible electrophotographic imaging member is free of an anticurl backing layer and said at least one imaging layer comprises a charge generating layer and a charge transport layer, said charge transport layer comprising said ethylcarboxylate diamine.

* * * * *